US006059447A

United States Patent [19]

Paris

[11] Patent Number: 6,059,447

[45] **Date of Patent: *May 9, 2000**

[54] METHOD FOR MIXING PHOSPHOGYPSUM WITHIN EARTHEN MATERIAL

[76] Inventor: James L Paris, 5403 E. Decker Rd., Custer, Mich. 49405

[ * ] Notice: This patent issued on a continued prosecution application filed under 37 CFR 1.53(d), and is subject to the twenty year patent term provisions of 35 U.S.C. 154(a)(2).

[21] Appl. No.: 09/006,349

[22] Filed: Jan. 13, 1998

[51] Int. Cl.[7] ..... B01F 13/00

[52] U.S. Cl. ..... 366/271; 405/128; 405/258

[58] Field of Search ..... 366/271, 345, 366/346; 405/128, 180, 258, 263, 264, 266, 267, 269; 71/903

[56] References Cited

U.S. PATENT DOCUMENTS

| | | | |
|---|---|---|---|
| 4,069,678 | 1/1978 | Miura et al. . | |
| 4,448,566 | 5/1984 | King | 404/31 |
| 4,662,946 | 5/1987 | Mercer | 106/284.01 |
| 4,714,379 | 12/1987 | Gilchrist, Jr. . | |
| 4,871,281 | 10/1989 | Justice . | |
| 5,118,230 | 6/1992 | Justice . | |
| 5,242,246 | 9/1993 | Manchak, III et al. . | |
| 5,348,422 | 9/1994 | Manchak, III et al. . | |
| 5,349,765 | 9/1994 | Kitanaka et al. . | |
| 5,401,119 | 3/1995 | Washington et al. . | |
| 5,597,339 | 1/1997 | Basu et al. | 71/9 |
| 5,639,182 | 6/1997 | Paris | 405/128 |

*Primary Examiner*—W. L. Walker
*Assistant Examiner*—Terry K. Cecil
*Attorney, Agent, or Firm*—Price, Heneveld, Cooper, DeWitt & Litton

[57] ABSTRACT

An in situ method of mixing a first material with a second material involves disposing the second material over a layer of the first material, disposing a mixing apparatus through the first and second layers of material, and mixing the first and second materials with the mixing apparatus. The mixing apparatus includes an endless cutting assembly which is movable along a loop path. The cutting assembly includes a plurality of teeth which convey the second material downwardly and mix the second material with the underlying layer of the first material. The method has particular application in converting mineral waste materials such as phosphogypsum into useful mixtures which can be used as construction fill.

16 Claims, 7 Drawing Sheets

METHOD FOR MIXING PHOSPHOGYPSUM WITHIN EARTHEN MATERIAL

BACKGROUND OF THE INVENTION

This invention relates to methods and apparatus for mixing strata of material, and more particularly to methods and apparatus for mixing layers of solid and/or semi-solid materials on the surface of the earth to convert certain materials, such as waste byproducts, into more useful materials, such as fill material for roadbeds and the like.

A specific example of a material which is generally regarded as being unusable, but which could potentially be mixed with another material to form a useful fill material, is phosphogypsum. Phosphogypsum is a byproduct from the production of phosphoric acid, which is used in a dehydrated form as fertilizer. Phosphate rock mined from the earth contains a small amount of radionuclides. After the phosphoric acid is produced from the ore, the byproduct phosphogypsum has a slightly higher concentration of radionuclides than the unprocessed ore. The EPA restricts the use of materials containing more than 10 picocuries per gram. Most of the nearly 1 billion tons of byproduct phosphogypsum stocked piled in Florida and adjoining states averages 30 picocuries per gram.

The Florida Institute of Phosphate Research (FIPR) has, for many years, been attempting to develop environmentally acceptable ways of utilizing the huge stock piles of phosphogypsum byproducts for economic benefit. A proposed use for phosphogypsum byproduct which is expected to be deemed environmentally acceptable involves mixing phosphogypsum byproducts with another earthen material, such as soil, sand, stone, clay, loam, and/or other byproduct materials such slag, dross, cinder, and the like, or combinations thereof. Such materials can be mixed to form aggregates which are environmentally acceptable and which exhibit suitable properties, such as good packing, percolation and the like, for use as a fill material for roadbeds, airport runways, parking lots, sound abatement berms, and earthen levees.

Although mixtures or aggregates of earthen materials and waste materials could potentially be usefully employed as fill for roadbeds and the like, thus converting the large volumes of unused materials into valuable construction materials and concomitantly freeing large areas of land on which such waste materials are stock piled for more valuable and/or productive uses, a major impediment to implementation of such beneficial practices is the apparent difficulty in economically forming such aggregates. The use of conventional mixing equipment for forming bulk aggregates, such as equipment typically used for preparing concrete and cement, would be prohibitively expensive. The use of conventional earth moving equipment, such bulldozers, excavators and the like, can mix bulk quantities of waste materials with earthen materials would also be impractical because of the difficulty, time and expense associated with achieving sufficiently thorough mixing.

Known equipment for in situ mixing of strata of material are generally only capable of reaching a depth of about two feet. Although such known equipment may be successfully employed for mixing strata of material to convert undesirable mineral byproducts into useful construction fill materials, even greater economic and environmental benefits could be attained with methods and apparatus for in situ mixing of material strata to a greater depth.

SUMMARY OF THE INVENTION

If The invention relates to a method of mixing a first material with a second material by disposing the second material over a layer of the first material, disposing a mixing apparatus through the first and second materials, the mixing apparatus including an endless cutting assembly which is movable along a loop path, the cutting assembly including a plurality of teeth which convey material downwardly and mix the second material with underlying material in the first layer, and mixing the materials by moving the cutting assembly along the loop path.

DESCRIPTION OF THE PREFERRED EMBODIMENT

Words such as upward, downward and the like which are used to indicate spacial relationships of various components of the apparatus of the invention are to be interpreted with reference to the drawings and are to be given their ordinary meaning unless otherwise indicated.

Figure 1:
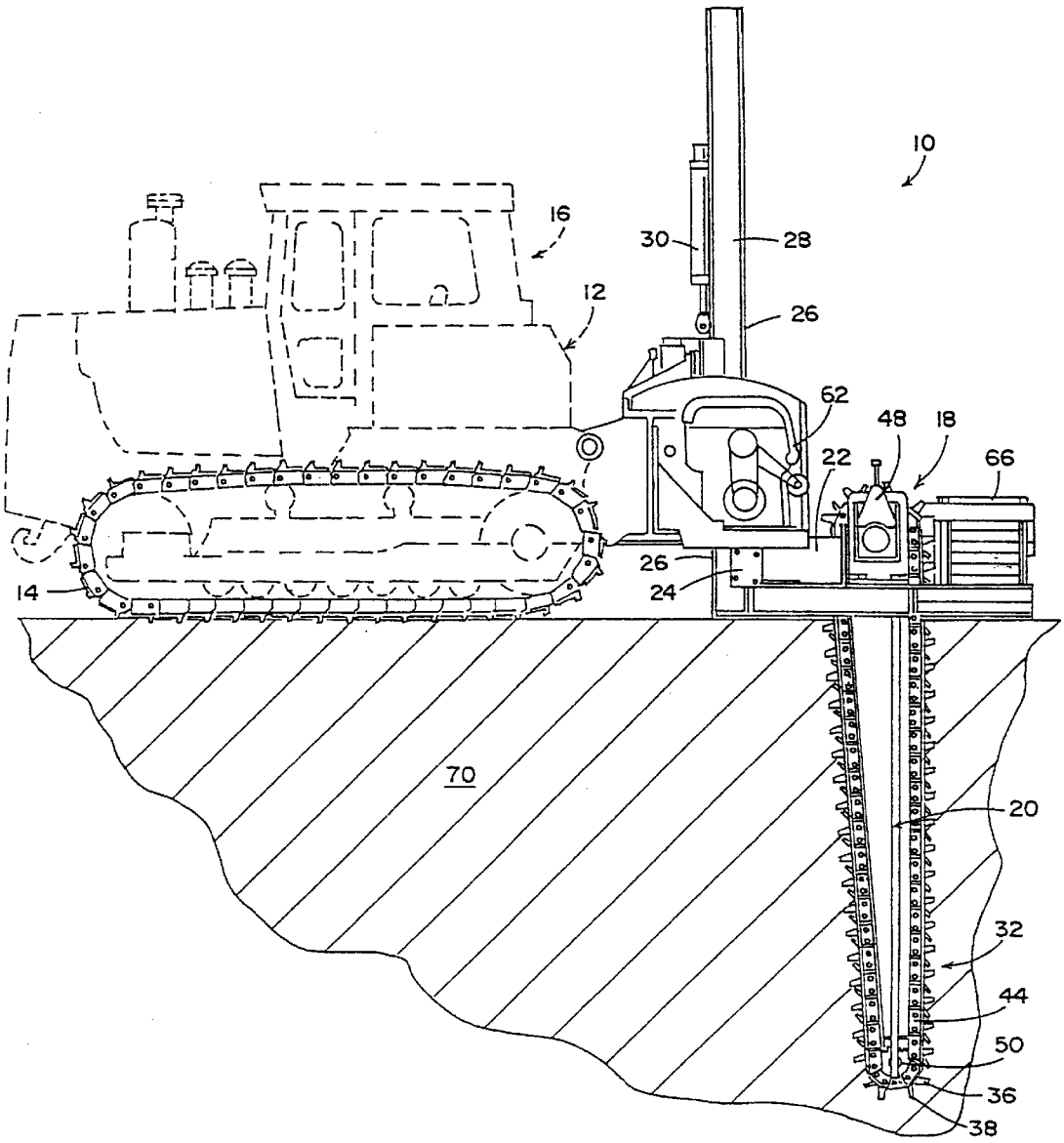
FIG. 1 is a side elevational view of a mobile machine for the in situ mixing of material in accordance with the invention, with the mixing apparatus fully extended into the ground to its maximum operating depth.
Figure 4:
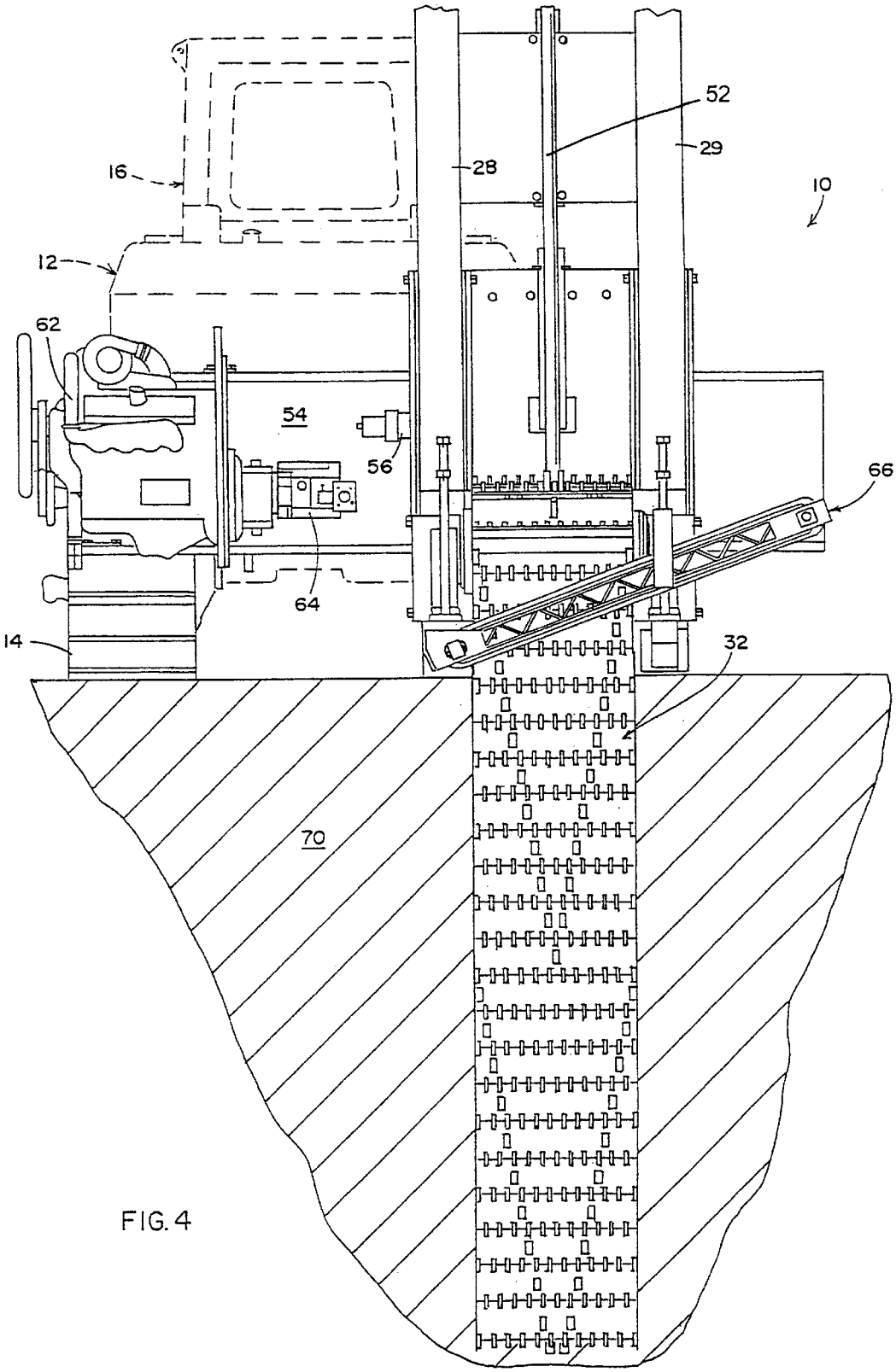
FIG. 4 is a rear view, similar to FIG. 2, except with the cutting assembly fully extended to its maximum operating depth.
Figure 5:
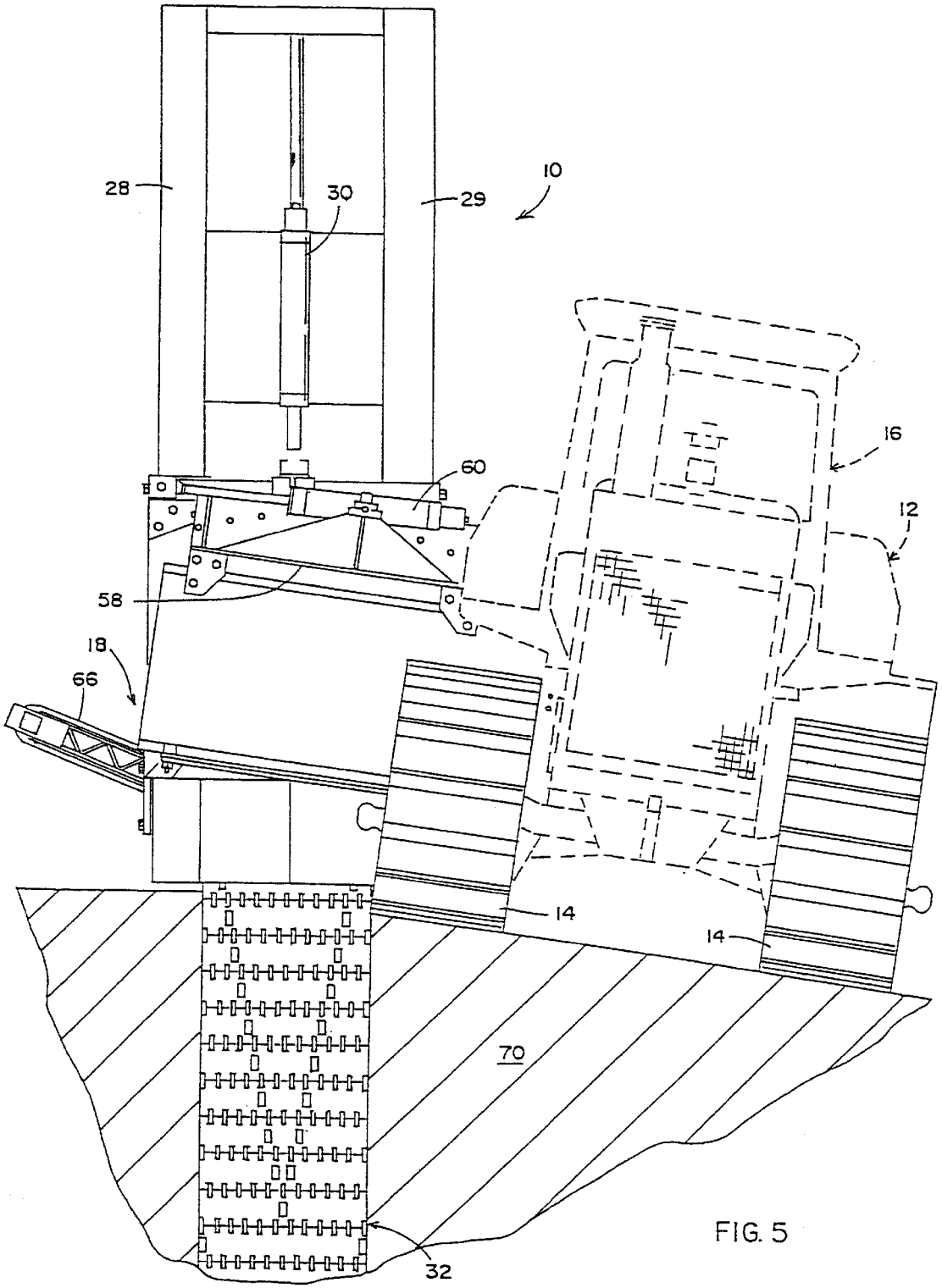
FIG. 5 is a front elevational view of the machine shown in FIG. 1, with the tractor tilted to one side while the mixing apparatus is maintained in a vertical position, to illustrate the tilt compensation feature which allows the machine to pass over uneven terrain without the cutting assembly deviating from treating an the even, straight path of material.

As shown in FIG. 1, the mixing machine 10 includes a self-propelled vehicle or carrier such as a tractor 12 having treads 14 for propelling the machine over strata of materials which are to be mixed. Alternatively, tractor 12 can be provided with wheels if desired. The tractor 12 includes an operator's cab 16 with conventional controls and instrumentation as would typically be found on standard earth moving or trenching machines. Mounted on the tractor 12 is a specially designed vertical mixing apparatus 18. Mixing apparatus 18 includes a boom 20, the upper end of which is supported by a pair of arms 22, 23 projecting horizontally away from the boom. The projecting ends of arms, 22, 23 each include a trolley assembly 24, 25 which rides on a rail or flange 26, 27 of an I-beamed shaped mast 28, 29, whereby boom 20 can be raised and lowered by means of hydraulic cylinder 30 (FIGS. 4 and 5). An endless cutting assembly 32, disposed on boom 20 is moveable along a loop to continuously convey material downwardly into and through the strata when the boom is lowered, whereby the various strata of material adjacent cutting assembly 32 are thoroughly and substantially homogeneously mixed.

Figure 2:
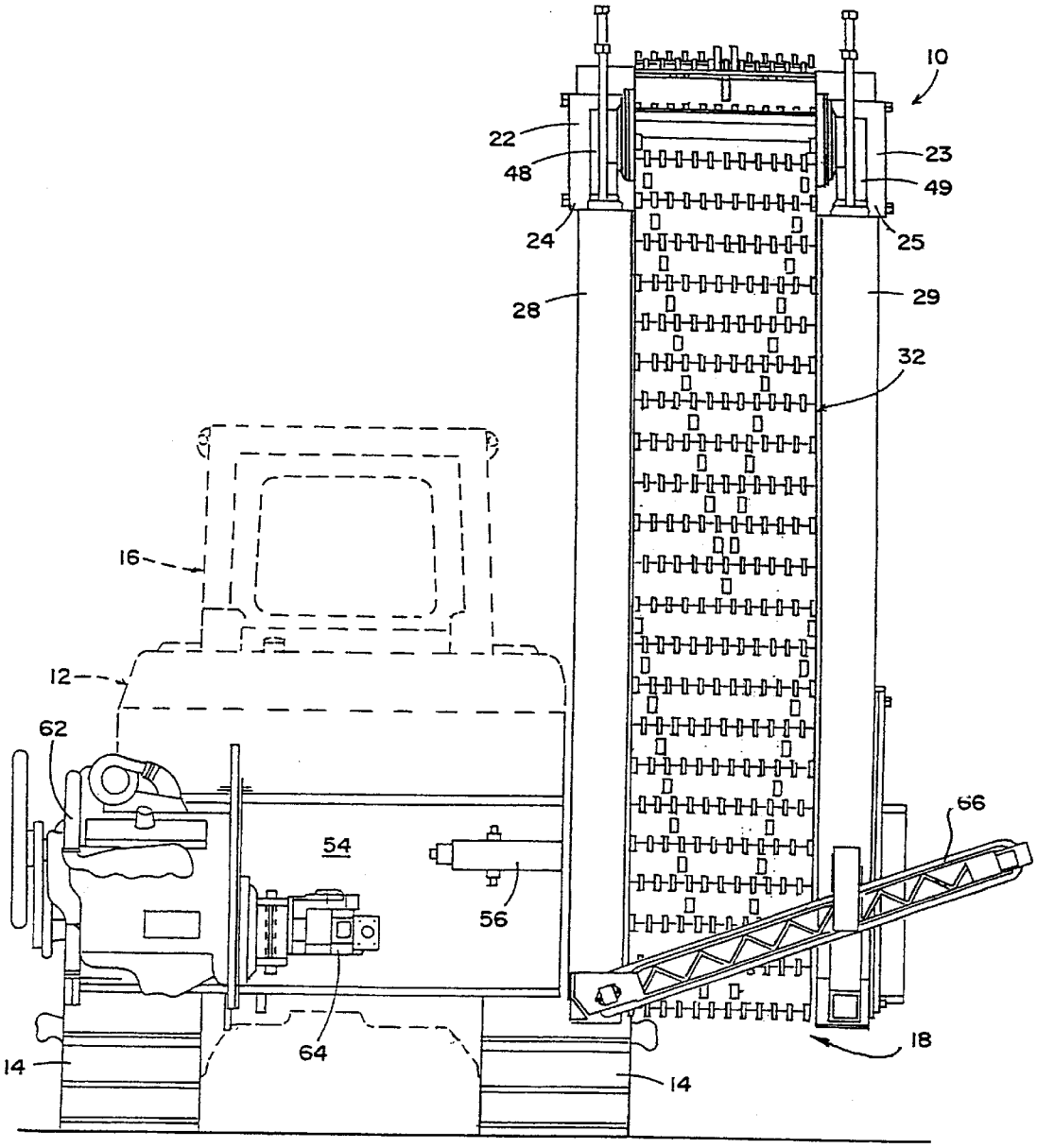
FIG. 2 is a rear elevational view of the machine shown in FIG. 1A.
Figure 3:
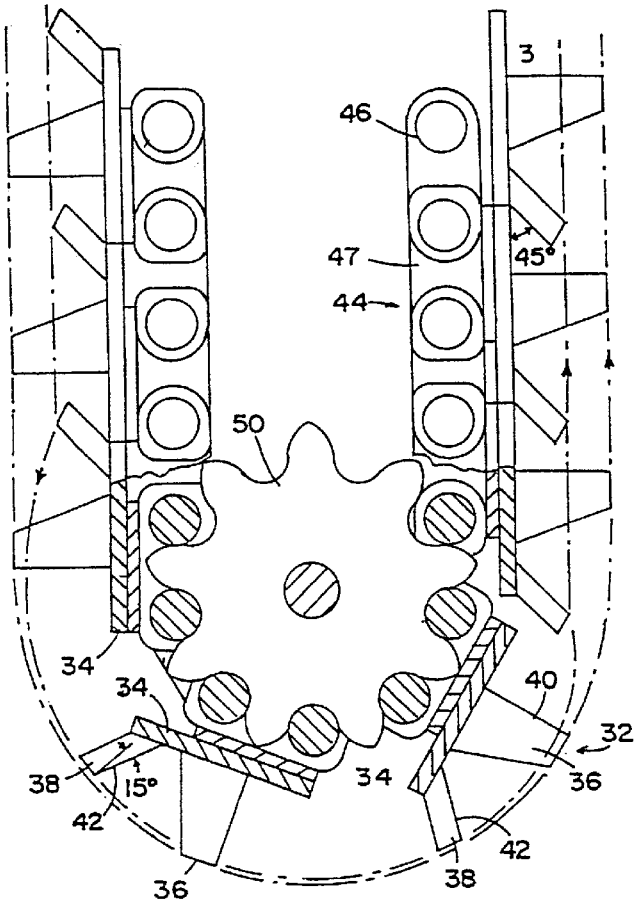
FIG. 3 is an enlarged fragmentary elevational cross-section of the cutting assembly of the machine shown in FIG. 1.

The cutting assembly 32, as best illustrated in FIG. 3, is comprised of a plurality of tooth pads 34 which are linked together into an endless loop. The tooth pads 34 each have a plurality of teeth which project away from a substantially flat surface which is generally parallel to the direction in which the chain travels when in operation. The cutting assembly 32 includes two different types of teeth, including cutting teeth 36 and relatively smaller impeller teeth 38. Cutting teeth 36 have a leading edge 40 which is substantially perpendicular to the direction of travel of cutting assembly 32 when in operation. As can be seen in FIG. 2, the cutting teeth 36 are arranged on cutting assembly 32 to form a plurality of the V-shaped patterns. The cutting teeth 36 are designed to break up or loosen material and convey material near the surface downwardly where it is thoroughly mixed with material in underlying strata. The relatively smaller impeller teeth have a leading edge 42 which is swept backwardly and away from pads 34 at an angle of about 30 to 60 degrees, and preferably at about 45 degrees from a line horizontal to the flat outwardly facing plane of pad 34. The impeller teeth 38 are located on the trailing end of the pads 34, which are cantilevered off of the links 46, so that the angle of leading edges 42 of teeth 38 with respect to a line in the plane of the teeth 38 which is perpendicular to the direction of travel of the impeller teeth is about 45 degrees as the teeth 38 travel upwardly and downwardly, and about 15 degrees when the teeth 38 swing outwardly along the semi-circular path at the bottom of the loop. The 15 degree pitch of teeth 38 cause material to be effectively pushed or raked around the bottom of the loop without jamming. The impeller teeth 38 sweep outwardly to prevent loose material from building up under the turning radius of the cutting assembly, and to mix the material and move it upwardly and outwardly at the upwardly moving return side of the cutting assembly. The angled impeller teeth 38 are located near the trailing side of the pads 34 behind the cutting teeth 36, which are approximately centrally located between the leading and trailing sides of the pads. Impeller teeth 38 do not interfere with the action of teeth 36 on the downward cutting side of the cutting assembly 32.

As can be seen in FIG. 2, the illustrated cutting assembly 32 of mixing apparatus 18 includes forty-eight tooth pads 34 with cutting teeth 36 arranged thereon to form four consecutive, repeating V-shaped patterns, each comprised of 12 pads. The leading pad of each 12 pad repeat patterns includes 2 cutting teeth 36 which are generally mounted at opposite ends along the length of pad 34. The second pad 34, adjacent the leading pad, also includes two cutting teeth 36, but which are spaced slightly closer together. Each successive pad, from the leading pad to the trailing pad of each repeat pattern, has two cutting teeth which are progressively closer together, with the trailing pad having a single centrally positioned cutting tooth.

The impeller teeth 38 are generally disposed in parallel rows which run across the width of the cutting assembly. More specifically, with reference to the illustrated embodiment, there is one row of impeller teeth associated with each pad 34. Impeller teeth 38 are mounted substantially at the trailing edge of pad 34, so that cutting teeth 36 are located between the rows of impeller teeth. Impeller teeth 38 are preferably uniformly spaced apart along each row, and alternate rows are preferably staggered so that impeller teeth in one row are aligned with the spaces between impeller teeth of an adjacent row, with respect to the direction of movement of chain 32. The illustrated tooth arrangement provides efficient mixing of various strata of material in an economical, single pass operation. The tooth pads 34 are mounted onto a pair of spaced apart, parallel, pitch chains 44 comprised of a plurality of links 46, 47, which are pivotally connected together in a conventional manner. The chains 44 are driven by a drive gear (not shown) having teeth which engage complementary recesses in the chains. The drive gear can be driven by any suitable means such as hydraulic motors 48, 49. An idler gear 50 mounted at the lower end of boom 20 maintains tension on the cutting assembly 32 as it travels a looped path around the drive gear and idler gear. The cutting assembly 32 has relatively fewer teeth than conventional excavating equipment such as trenchers in order to provide generally higher forces or pressures along the leading edge of the teeth. Increased pressure or forces along the leading edge of the teeth is especially desirable for breaking up hard materials to achieve better mixing.

A suitable cutting tooth length, as measured along the leading edge thereof, is about 2 to about 6 inches, and preferably about 4 inches. The angled impeller teeth 38 preferably project away from the surface of the pads 34 so that the portion thereof farthest from the pad is from about 1 to about 3 inches, and preferably about 2.25 inches, from the pad. The position and angle of the impeller teeth 38 relative to the cutting teeth 36 is such that the distal edge of the impeller teeth 38 (i.e. the edge farthest from the pad) traverses an arcuate path at the lower end of the boom 20. The arcuate path defined by the distal edge of the impeller teeth has a radius which is only slightly less than the radius of the path traversed by the distal edge of the cutting teeth (i.e. edge which is furthest from the pad). A suitable width for the pad is about 8 inches. A suitable pitch of the chain 44 (i.e. the distance between adjacent rotational axis on the length of the chain) is about 4 inches. A suitable pitch diameter for the idler gear is about 12 inches. A satisfactory length for each pad 34 (i.e. the cutting width of the cutting assembly 32) is about 36 inches. Based on the foregoing dimensions a cutting assembly having 48 pads has a total circumference or loop length of about 32 feet, and the working depth is approximately 12.5 feet. A suitable thickness for the teeth 36, 38 is about 1 inch. The above recited dimensions are for purposes of illustrating a machine 10 according to the invention which in most cases is adequately suited for mixing solid materials such as soil, hardened sludge and mineral water materials in situ. However, any or all the above dimensions and parameters can be varied if desired. For example, longer and wider mixing apparatuses are possible if a large engine is used. As another example, longer mixing apparatuses can be used without requiring a more powerful engine if the width of the mixing apparatus is made narrower. Additionally, the number of teeth, tooth geometry, tooth patterns, and tooth dimensions, can all be varied without departing from the broader principles of the invention.

While chain type cutting assemblies are preferred, especially for processing hard, solid materials, flexible cutting assemblies, such as a rubber belt with hardened teeth disposed thereon, may be useful, especially for processing soft or fluid materials.

In addition to the boom 20, along with cutting assembly 32, being vertically moveable downwardly to penetrate the material strata to a depth of about to 12.5 feet, and vertically moveable upwardly so that the boom can be fully withdrawn from and suspended above the strata of material. Mast 28 is also vertically moveable as can be seen by comparing FIG.

Figure 1A:
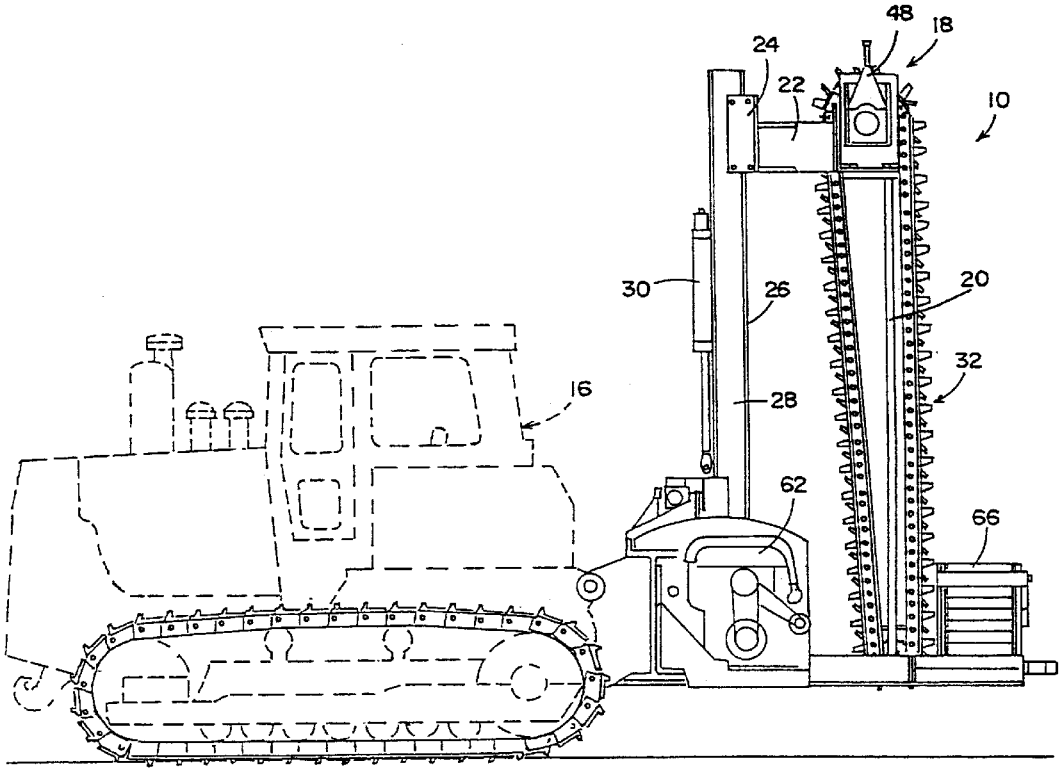
FIG. 1A is a side elevational view of the machine shown in FIG. 1, with the mixing apparatus raised above the ground for transport clearance.

1A, which shows the mast 28 lowered to ground level and boom 20 fully deployed into the ground, with FIG. 1A which shows the mast raised above the ground and the boom fully raised for transport clearance. A suitable amount of vertical travel for the mast 28 is about 30 inches (from about 8 inches below ground level to about 22 inches above ground level). A suitable amount for travel for boom 20 is about 150 inches. Mast 28 can be vertically moved by any of various suitable means such as a hydraulic cylinder 30. The cutting assembly 32 can be raised or lowered relative to the mast 28 by any of various suitable means, such as by rotating a lead screw 52 (FIG. 9 ) attached to a lead nut (not shown) which is in fixture with the cutting assembly. Lead screw 52 can be rotated with a hydraulic motor (not shown).

In accordance with a preferred aspect of the invention, the machine 10 is provided with various enhancing features which allow the operator to negotiate uneven terrain and deviate slightly from driving a straight line, while the boom can be maintained in a vertical attitude and guided along a linear path. More specifically, mast 28 is mounted on a base member 54 for lateral movement with respect thereto, and to tractor 12, so that the mixing apparatus 18 can follow a straight line path while the tractor deviates, such as up to about 2 feet from a straight path across the area being treated. The lateral position of mast 20 is preferably automatically adjusted by means of a hydraulic cylinder 56 (FIGS. 2 and 4) which is electronically controlled in response to a laser sensor 58 (FIG. 5) which tracks a vertical plane of light. The machine 10 is also provided with a tilt compensation feature which maintains mixing apparatus 18 in a vertical attitude while tractor 12 can be tilted sideways, such as about up to 7.5 degrees in either direction, so that the tractor can travel an uneven surface without affecting the verticality of the mixing apparatus. The attitude of the mixing apparatus 18 is preferably automatically adjusted by a hydraulic cylinder 60 which is controlled by a verticality sensor. The combination of straight-line guidance and verticality control ensures that the mixing apparatus processes a width of material equal to the full width of the cutting assembly 32 on every pass of the machine 10 over an area of material strata which are to be mixed, without missing or over processing any material. Hydraulic cylinders 30, 56, 60 and hydraulic motors 48, 49 are powered by a diesel engine 62 with hydraulic pumps 64, which are mounted to base member 54. A 540 horsepower diesel engine provides satisfactory power for the described embodiment. However, a more powerful engine would be required for a machine having a longer boom and mixing apparatus or having wider tooth pads 34, while a less powerful engine would be adequate for a machine having a shorter boom or narrower tooth pads.

Mounted to the lower end of mast 28 is an open conveyer belt 66 which moves expanded material to the side. During mixing of the strata of material, the mixed material has a tendency to expand or erupt. The expanded or erupted material enters open conveyer belts 66 and is windrowed to the side, out of the way of the machine.

Figure 6:
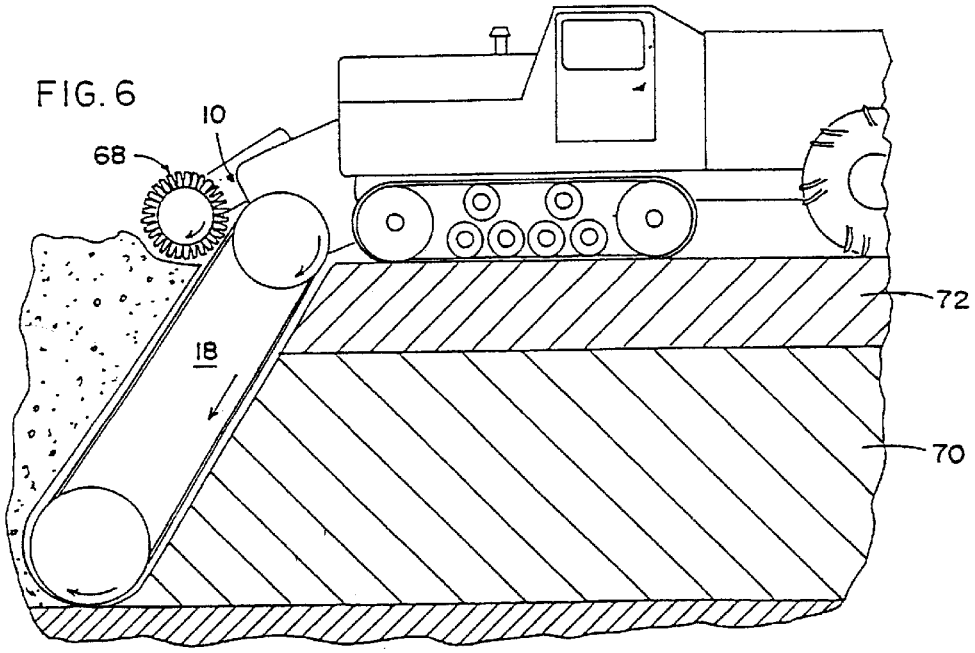
FIG. 6 is a side elevational view of an alternative embodiment of the invention, wherein a rotating flap wheel is utilized to prevent mixed material from being recirculated and to move expanded or erupted material to one side of the machine.

In FIG. 6 there is shown another embodiment of the invention which is generally similar to that of the embodiment shown in FIG. 1 through 5 and described above, except that instead of having an open conveyor for moving expanded or erupted material to the side, there is provided a stripper or flap wheel 68 constructed from strips of rubber or the like, such as from strips of heavy equipment tires. The rubber strips on the flap wheel 68 impinge upon teeth 36, 38, and pads 34 of the mixing apparatus 18 to remove expanded or erupted material therefrom, whereby the material is prevented from being recirculated and is instead swept to the side, away from the path of the machine.

Figure 7:
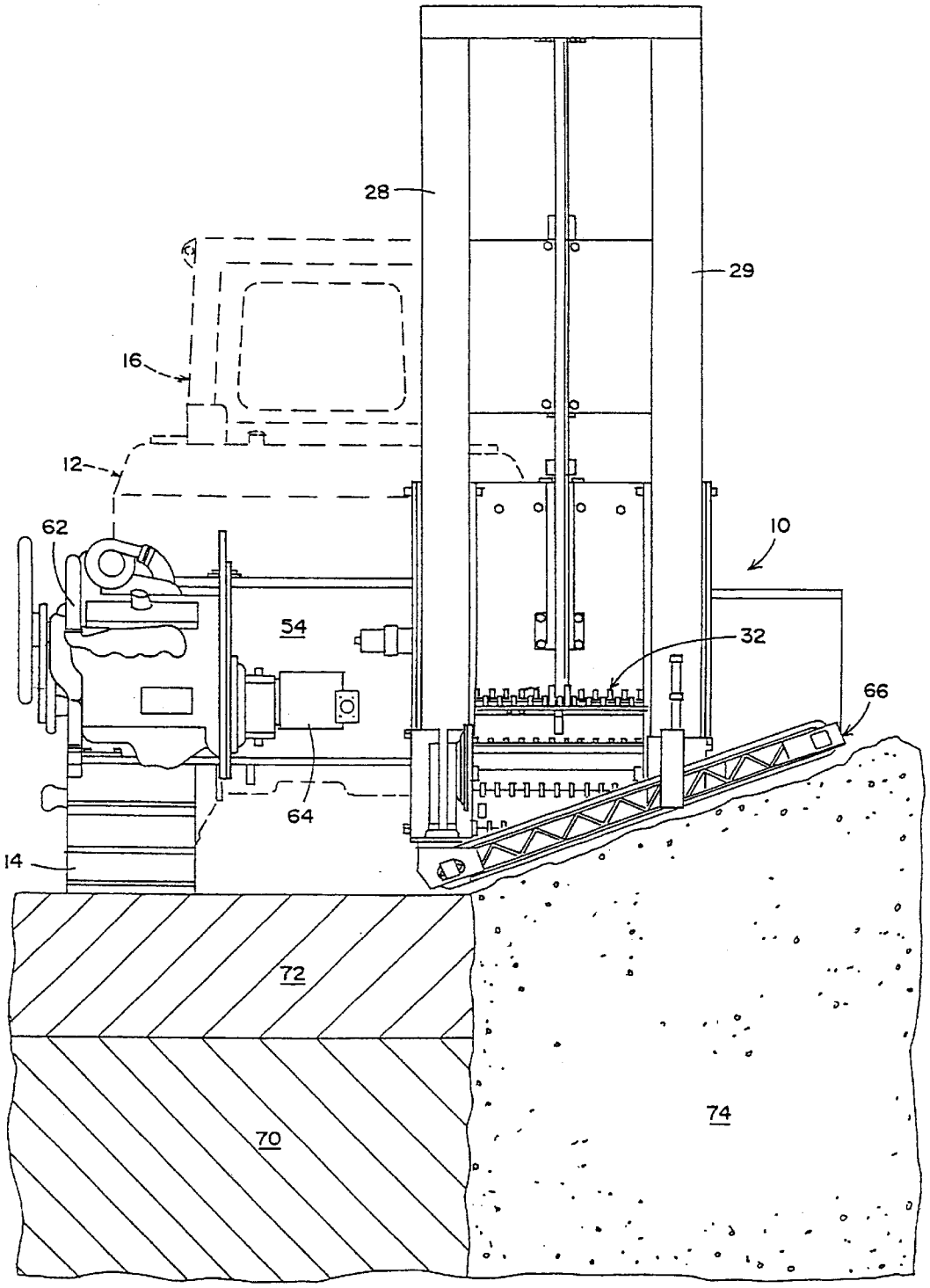
FIG. 7 is a rear elevational view of the machine shown in FIG. 1, and a partial cross-section of a site in which layers of material are to be mixed.

With reference to FIG. 7, the mixing process of the invention involves disposing a second layer of material 72 over a first layer of material 70, and mixing the first and second layers of material by moving the cutting assembly 32 along a loop path. The invention has been illustrated with respect to mixing of 2 layers or strata 70 and 72. However, it will be readily appreciated that 3 or more layers of materials can be mixed in accordance with the methods and apparatus of this invention. The total depth of all layers of material which are to be mixed should not exceed the working depth of the cutting assembly.

While it is not essential, it is desirable that at least the top layer 72 of material should be approximately level before mixing the various layers using mixing machine 10. Leveling of the top layer of material 72 can be achieved using conventional earth moving equipment. After layer 72 has been disposed over layer 70, machine 10 is moved into position, typically at a corner or at an edge of an area which is to be treated, and mixing apparatus 18 is started (i.e., the cutting assembly 32 is set in motion about its looped path). Apparatus 18 is then slowly lowered into layers 70, 72 to the desired mixing depth. Tractor 12 is set in motion, preferably along a linear path to mix the areas in rows, strips, or passes. The first pass mixes a strip of layered materials having a parallepiped head shape. At the end of the first pass, the mixing apparatus is withdrawn from the ground, machine 10 is repositioned to mix materials at an adjacent, parallel strip, the mixing apparatus is lowered into the ground to the desired depth, and a second pass is made. Alternatively, rather than withdrawing the mixing apparatus from the layered materials, it may be possible to simply make a wide U-turn with the tractor and make the next pass without removing or reinserting the mixing apparatus. The entire area which is to be mixed is completed by successive, parallel, adjacent passes as needed.

During each pass, the material in upper layer 72 is pulled or conveyed down into the material in lower layer 70 by cutting teeth 36 on cutting assembly 32. Cutting teeth 36 also grinds, pulverize, or breakup the materials in layers 70 and 72 as material is pulled downwardly and mixed. Impeller teeth 38 move materials around the bottom of the loop and thoroughly blend the layers of material while moving material upwardly and downwardly.

As an alternative to disposing layer 72 over layer 70, such as with conventional earth moving equipment, before passing mixing machine 10 over the layers 70, 72 and mixing the layers with cutting assembly 32, it is possible to dispense a first material over a second material which is to be mixed with the first material directly in front of the cutting assembly as it is moved translationally through the second material.

The linear speed of the cutting assembly 32 can vary considerably depending on various factors such as the size of the teeth 36, 38, length of assembly 32, the power of diesel engine 62, characteristics of the materials which are to be mixed, etc. However, for the embodiment having the particular specifications and dimensions set forth above, a typical cutting assembly speed can range up to about 20 feet per second, and more preferably from about 2 to 10 feet per second. As with the cutting assembly speed, the speed of tractor 12 can vary considerably, however, typical tractor speeds range from about 1 to about 10 feet per minute with the amount of the material being processed ranging from about 80 to about 800 cubic yards per hour, however, tractor speeds and cubic yardage may still be greater if shallower cutting depths or softer materials are involved.

The apparatus of the invention can be used in a manner somewhat different from that described above. In certain applications it may be desirable to introduce material directly in front of the progressing and down cutting assembly. This approach would eliminate the increased elevation associated with a pre-applied layer. The material introduced directly in front of the progressing and down cutting assembly could be dispensed from a container attached to the carrier or one traveling in unison with the carrier. The action of conveyor belt 66, or alternatively flap wheel 68, will ramp relatively higher windrows, up and away from the next pass.

While the invention shares many features with conventional trenching apparatuses, it should be pointed out that there are significant differences and that the machine of the invention is not a trencher and does not cut or leave a trench. To the contrary, the apparatus of the invention is primarily and substantially exclusively a mixing apparatus which loosens, conveys and mixes solid materials such as soils, mineral waste byproducts, and the like. The primary difference between trenching tools and the present invention is that conventional trenching tools include a series of milling teeth and buckets or soil elevators which excavate soil from a trench, whereas the apparatus of the invention is provided with teeth but does not include buckets or soil elevators which are intended to lift substantial amounts of soil from the ground to form a trench. Additionally, in operation the teeth on the forward moving side of the cutting assembly move downwardly, whereas the converse is true for conventional trenching machines.

It is contemplated that the in situ method of mixing a first material with a second material can be performed either at the location at which the mixed materials are to be used or at a location remote from the location at which the mixed materials are to be used. For example, in converting phosphogypsum into useable construction fill material, earthen material which is to be mixed with the phosphogypsum can be transported to the site at which the phosphogypsum is stockpiled, disposed over the stockedpiled phosphogypsum, and subsequently mixed with the phosphogypsum in accordance with the method of this invention. As another alternative, the phosphogypsum could be transported to a site at which the construction fill material is to be utilized, dispersed over the ground to form a first layer, and mixed with a second material which is disposed over the layer of phosphogypsum. As another alternative, the phosphogypsum could be disposed over a layer of material preexisting at a site at which the mixed materials are to be utilized, and subsequently mixed with the preexisting layer in accordance with the methods of this invention.

The method of this invention can be used in various other applications where it is desirable to mix a first layer of material with a second material. The method is believed to have particular utility in applications involving the conversion of mineral waste materials, such as dross, slag, etc., and especially phosphogypsum, into useful materials by mixing with earthen materials, such as soil, clay, said, and mixtures thereof.

What is claimed is:

1. A method of using phosphogypsum as a construction fill material, comprising:

disposing the phosphogypsum over a layer of earthen material;

disposing a mixing apparatus through the earthen material and the phosphogypsum, to a depth greater than two feet, the mixing apparatus including a plurality of tooth pads which are linked together in an endless cutting assembly which is movable along a loop path, the cutting assembly including a plurality of teeth for conveying the phosphogypsum downwardly and mixing the phosphogypsum with the earthen material; and mixing the phosphogypsum and earthen material by moving the mixing apparatus translationally through the phosphogypsum and earthen material and moving the cutting assembly along the loop path, with the teeth moving downwardly on a forwardly moving side of the cutting assembly and upwardly on a trailing side of the cutting assembly.

2. The method of claim 1, wherein the plurality of teeth include a plurality of cutting teeth which breakup and loosen soil, and convey material downwardly; and a plurality of impeller teeth which mix and induce loose material to move upwardly and outwardly, the impeller teeth projecting from the cutting assembly by a distance which is less than that of the cutting teeth.

3. The method of claim 2, wherein the impeller teeth are disposed in parallel rows and the cutting teeth are located between the rows of impeller teeth.

4. The method of claim 3, wherein the impeller teeth are staggered.

5. The method of claim 4, wherein the cutting teeth project outwardly from the cutting assembly by a distance of from about 2 inches to about 6 inches and the impeller teeth project outwardly from the cutting assembly by a distance of from about 1 inch to about 3 inches.

6. The method of claim 5, wherein a leading edge of the impeller teeth is swept backwardly in an angle of from about 30° to about 60° with respect to a lined orthogonal to an outwardly facing surface of the cutting assembly.

7. The method of claim 1, wherein the phosphogypsum is dispensed onto the earthen material as the cutting apparatus is moved translationally through the phosphogypsum and earthen material.

8. The method of claim 1, wherein the cutting apparatus is moved translationally through the phosphogypsum and earthen material at a speed of 10 or more feet per minute.

9. The method of claim 1, wherein the earthen material comprises soil, clay, sand, or a mixture thereof.

10. The method of claim 1, wherein the cutting assembly is mounted on a mobile carrier and is moved translationally through the phosphogypsum and earthen material which are to be mixed.

11. The method of claim 1, wherein a bottom of the cutting assembly is extended to a depth equal to the total depth of the phosphogypsum and earthen material which are to be mixed.

12. The method of claim 1, wherein mixing of an area of layered phosphogypsum and earthen material is achieved by completing a plurality of successive parallel adjacent passes.

13. The method of claim 1, wherein the cutting assembly moves at a speed up to about 20 feet per second.

14. The method of claim 1, wherein the mixing apparatus is disposed through the earthen material and the phosphogypsum to a depth of about 12.5 feet.

15. A method of using phosphogypsum as a construction fill material, comprising:

disposing the phosphogypsum over a plurality of layers of material;

disposing a mixing apparatus through the phosphogypsum and the plurality of layers of material to a depth greater than two feet, the mixing apparatus including a plurality of tooth pads which are linked together in an endless cutting assembly which is movable along a loop path, the cutting assembly including a plurality of teeth for conveying the phosphogypsum downwardly and mixing the phosphogypsum with the underlying layers of material; and mixing the phosphogypsum and the underlying layers of material by moving the mixing apparatus translationally through the phosphogypsum and earthen material and moving the cutting assembly along the loop path, with the teeth moving downwardly on a forwardly moving side of the cutting assembly and upwardly on the trailing side of the cutting assembly.

16. The method of claim 15, wherein the mixing apparatus is disposed through the phosphogypsum and the plurality of layers of material to a depth of about 12.5 feet.

* * * * *

UNITED STATES PATENT AND TRADEMARK OFFICE

CERTIFICATE OF CORRECTION

PATENT NO. : 6,059,447
DATED : May 9, 2000
INVENTOR : James L. Paris

It is certified that error appears in the above-identified patent and that said Letters Patent is hereby corrected as shown below:

Title Page, [54]:

"METHOD FOR MIXING PHOSPHOGYPSUM WITHIN EARTHEN MATERIAL" should be - -METHOD FOR MIXING PHOSPHOGYPSUM WITH AN EARTHEN MATERIAL- -.

Column 1, Lines 1 and 2:

"METHOD FOR MIXING PHOSPHOGYPSUM WITHIN EARTHEN MATERIAL" should be - -METHOD FOR MIXING PHOSPHOGYPSUM WITH AN EARTHEN MATERIAL- -.

*Column 1, Line 21:
"stocked piled" should be - -stockpiled- -;

*Column 1, Line 32:
After "such" insert - -as- -;

*Column 1, Line 52:
Before "can" insert - -that- -;

*Column 1, Line 57:
"are" should be - -is- -;

Column 1, Line 66:
Delete "If";

UNITED STATES PATENT AND TRADEMARK OFFICE

CERTIFICATE OF CORRECTION

PATENT NO. : 6,059,447
DATED : May 9, 2000
INVENTOR : James L. Paris

It is certified that error appears in the above-identified patent and that said Letters Patent is hereby corrected as shown below:

*Column 2, Line 32:
"an the even" should be - -an even- -;

*Column 6, Line 41:
"grinds" should be - -grind- -;

*Column 7, Line 41:
"stocked piled" should be - -stockpiled- -;

Column 7, Line 59:
"said should be - -sand- -.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*